US010469949B1

(12) United States Patent
Wiersum

(10) Patent No.: US 10,469,949 B1
(45) Date of Patent: Nov. 5, 2019

(54) LOUDSPEAKER IMPEDANCE MATCHING DEVICE FOR NON-PERMANENT APPLICATIONS

(71) Applicant: Benjamin K. Wiersum, Bolingbrook, IL (US)

(72) Inventor: Benjamin K. Wiersum, Bolingbrook, IL (US)

(73) Assignee: Wiersum Enterprises, Inc., Naperville, IL (US)

( * ) Notice: Subject to any disclaimer, the term of this patent is extended or adjusted under 35 U.S.C. 154(b) by 0 days.

(21) Appl. No.: 15/983,061

(22) Filed: May 17, 2018

(51) Int. Cl.
*H04R 9/02* (2006.01)
*H04R 3/12* (2006.01)
*H01F 27/28* (2006.01)

(52) U.S. Cl.
CPC ..... *H04R 9/02* (2013.01); *H01F 27/2828* (2013.01); *H04R 3/12* (2013.01)

(58) Field of Classification Search
CPC ..... H04R 9/02; H04R 3/12; H01F 27/2828
USPC ..... 381/400
See application file for complete search history.

(56) References Cited

U.S. PATENT DOCUMENTS 4,538,296 A * 8/1985 Short ..... H04R 3/007 361/75
8,374,380 B2 * 2/2013 Tang ..... H04R 9/046 381/400
2004/0175002 A1 * 9/2004 Christensen ..... H04R 29/007 381/59
2008/0044038 A1 * 2/2008 Houle ..... H04S 1/002 381/97
2009/0296953 A1 * 12/2009 Sakata ..... G10H 1/0008 381/80
2014/0301577 A1 * 10/2014 Togawa ..... H03F 3/217 381/120
2017/0070195 A1 * 3/2017 Arknæs-Pedersen .... H04R 3/12

* cited by examiner

*Primary Examiner* — Sean H Nguyen
(74) *Attorney, Agent, or Firm* — Chicago IP Law; Steven M. Evans

(57) ABSTRACT

An impedance matching device including a transformer having an input side and an output side, wherein the input side includes a first coil having a first impedance, a second coil having a second impedance, and a third coil having a third impedance. An input power connector is electrically connected to the input side of the transformer, and a pass through output power connector is electrically connected to the input side of the transformer, and the pass through output connector also is electrically connected in parallel to the input power connector. A speaker output connector having four electrical contacts is included, wherein a first pair of the four electrical contacts is connected electrically to the first coil, and a second pair of the four electrical contacts is connected electrically to the second coil.

20 Claims, 12 Drawing Sheets

(Prior Art)

(Prior Art)

20
Loudspeaker Output
200 Volt Line
1+
1-
2-
2+
8 ohms
4 ohms
com
150W
300W
600W
com
23
26
28
30
31
32
33
34
35
36
37
38
39
40
42
44
46
48
59

(Prior Art)

LOUDSPEAKER IMPEDANCE MATCHING DEVICE FOR NON-PERMANENT APPLICATIONS

BACKGROUND OF THE INVENTION

Field of the Invention

The present invention relates to impedance matching devices for use with sound reinforcement or playback loudspeakers for non-permanent applications, and more particularly, to improving efficiency of impedance matching within a temporary setup of a plurality of loudspeakers arranged at an outdoor event.

Description of Related Art

It is known in the prior art of several common practices for setting up and distributing signals to loudspeakers for various temporary or non-permanent applications. For example, a series of high power, often long-throw loudspeakers are typically provided in a centralized location. Such systems are often colloquially referred to as a "line array" and are typically supplied on either side of a stage for concert live sound reinforcement applications. Such arrays can also be free standing (ground stacked) or suspended independently from freestanding towers. Systems of this design are often employed to provide sound coverage in a limited area, with not much concern paid to the fact that it is virtually guaranteed that the overall sound pressure level (SPL) will be higher nearer to said loudspeakers, with a noticeable decrease in SPL as a listeners' distance from the systems is increased. Systems such as this often employ a series of amplifiers of various sizes and types controlled by electronic means or computer based processing. Certain loudspeakers may also have amplification and/or processing built into them (commonly referred to as a "powered loudspeaker," "active loudspeaker," or similar adages/colloquialisms). This has the advantage of simplifying the setup, as the need for external amplifiers or processors is reduced or eliminated. The complexity of the system can be increased, however, as each loudspeaker cabinet or enclosure needs to be supplied with an audio signal, power, and possibly also a data/control signal.

Smaller applications will frequently employ one or two pairs of loudspeakers. A typical disc jockey will likely provide one pair of loudspeakers for an event with attendance of 50 people or less. Said loudspeakers can be either passive (powered by an external amplifier, usually located elsewhere from the loudspeaker) or active. In passive applications, a typical loudspeaker enclosure containing a 12" or 15" low-frequency transducer and a 1" or 2" high frequency transducer controlled internally by a frequency divider network (crossover) will likely present a nominal impedance of 8 ohms to the amplifier to which it is connected. Virtually all commonplace amplifiers of practical use for such applications can operate within an impedance range of 2 or 4 to 8 ohms. It should be noted that most amplifiers can also operate at impedances greater than 8 ohms, but with reduced efficiency, resulting in a lower acoustical output. (Actual attainable SPL is dependent on the sensitivity rating of the loudspeaker to which the amplifier is connected). An amplifier capable of delivering 1,000 watts to a 2 ohm load would essentially be supplying 250 watts to each of 4 loudspeakers connected to it assuming each loudspeaker has an impedance of 8 ohms. If additional loudspeakers are required, an additional amplifier must be used. Such a setup is also at a disadvantage due to the nature of this setup operating at a relatively low voltage but with high current. Heavy gauge loudspeaker cable (12 AWG is common) must be utilized to prevent power loss and reduced overall SPL. As more loudspeakers are wired in parallel, the overall impedance of the system is decreased. Loudspeakers can also be wired in series, which increases the overall system impedance. This can lead to issues with the aforementioned amplifier operating inefficiently at impedances greater than 8 ohms. Such wiring methods are further burdensome by making troubleshooting difficult. A wiring fault or component failure anywhere in the system will disable the entire system. Each component will then need to be tested individually until the fault is discerned.

Permanently installed applications frequently employ impedance matching devices for use with loudspeakers affixed to walls or ceilings. Many manufacturers offer loudspeakers with impedance matching devices (typically a transformer or autotransformer) built into them. Loudspeakers equipped with such a device will sometimes include a bypass mechanism, allowing a vendor to stock one model that can be used in multiple applications. Impedance matching devices are frequently configured to allow different impedance combinations. An 8 ohm loudspeaker equipped with a commonly available 10-watt transformer (as commonly used in overhead paging applications such as retail stores) will usually have its secondary winding configured for 8 ohms. Its primary winding will usually have multiple connections to allow various power levels. A full, half, quarter, and eighth winding would allow this transformer to operate at either 10, 5, 2.5 or 1.25 watts. Such systems employ higher voltages, which in conjunction with the higher impedance of the transformer-matched loudspeakers reduces current on the loudspeaker lines, thereby reducing lost power. Typical system voltages are 25 or 70.7 volts, although higher voltages are used in specialized applications. A 10 watt transformer intended for use on a 70.7 volt system has a calculated nominal impedance of 499.849 ohms (rounded up to 500 ohms) at 10 watts, 1 k Ohms at 5 watts, 2 k Ohms at 2.5 watts, and 4 k Ohms at 1.25 watts. Significantly smaller wire can be used to supply a signal to the loudspeaker/transformer assembly. The abovementioned 10 watt loudspeaker/transformer assembly, when connected to a 70.7 volt amplifier, has a line current of 141 milliamps. This could easily be run several hundred feet over 18 AWG (American Wire Gauge) cable without a noticeable decrease in SPL. An overhead paging system located in a retail grocery store consisting of 62 loudspeakers, each equipped with a 10 watt transformer would present a collective load of 8.064 ohms to the amplifier to which they're connected. The amplifier must be of suitable size such that it can supply adequate voltage to the loudspeakers connected to it. Transformers or autotransformers can be connected to an amplifier's output to match the collective impedance of the connected loudspeakers to the amplifier's output. Many amplifier manufacturers offer as "off-the-shelf" products amplifiers capable of driving such systems directly, due to having a built-in/internal transformer, or through an output circuit design specifically configured to power distributed systems.

A system utilizing a higher quantity of smaller loudspeakers distributed throughout a large area will yield a more even coverage pattern as compared to using a smaller quantity of larger loudspeakers. This is highly desirable in circumstances where a uniform SPL is required throughout a very large area. Each impedance matching device has its own inefficiencies, commonly referred to as an insertion loss.

Such insertion losses are calculated and compared by the audio engineer designing the sound system. The insertion losses are typically mitigated by the line loss and resultant cost of larger cabling and a higher quantity of amplifiers that would be required by a low impedance system. Manufacturers offering loudspeakers for sale with such devices built in will often publish loudspeaker operating data that includes said insertion losses.

Loudspeakers employed in non-permanent applications are interconnected using a variety of removable connections. Specialized plugs and connectors, unique to the professional audio industry, are commonly used for portable and temporary loudspeaker interconnections. Such methods ensure that loudspeaker and line-voltage electrical wiring isn't (potentially lethally) interchanged. Such connections prevent each enclosure from having to be hard-wired each time it's used. The design of commonly used interconnects prevents personnel handling the wiring from being exposed to potentially hazardous voltages.

Typical sound systems will often utilize 2-conductor wiring methods. 1 conductor provides a signal from the amplifier, with the other conductor providing a return current path. Specialized multi-way loudspeaker arrays may utilize multi-conductor cable to provide multiple signals from an amplifier or set of amplifiers to a loudspeaker array. High power permanent applications may utilize a 3-conductor wiring method as a means to further reduce the effects of line loss when loudspeakers are spread over a very large area or in situations where even minor discrepancies between output levels is undesirable.

In order to provide an even SPL over a very large area on a temporary basis, current products available would require using a large quantity of low impedance loudspeakers, connected to a significant number of amplifiers by way of thousands of feet of cable. Readily available loudspeakers with impedance matching devices built in could be utilized. These loudspeakers are not typically designed for portable or temporary applications, and lack many features desirable for temporary applications. Readily available portable loudspeakers could be modified so as to include an impedance matching device with a bypass switch, but with the disadvantage of increased and undesirable weight.

It would be desirable to have the ability to utilize a large quantity of loudspeakers, spread throughout a large area, on a temporary basis for various events. Accordingly, it would be very desirable to provide an apparatus for temporarily connecting a plurality of loudspeakers that provides impedance matching capabilities for all connected loudspeakers in order to produce a consistent SPL from each loudspeaker, wherein such apparatus is energy efficient and economical to produce.

ASPECTS AND SUMMARY OF THE PRESENT INVENTION

An aspect of the present invention is to provide an apparatus that interconnects a large quantity of loudspeakers, spread throughout a large area, on a temporary basis for various events.

Another aspect of the present invention is to provide an apparatus that interconnects a plurality of loudspeakers while maintaining a consistent and practical impedance for the amplifier.

A further aspect of the present invention is to provide an apparatus that interconnects a plurality of loudspeakers while maintaining a consistent SPL for each of the loudspeakers.

An additional aspect of the present is to provide an apparatus that interconnects a plurality of loudspeakers which is economical to manufacture.

A further aspect of the present is to provide an apparatus that interconnects a plurality of loudspeakers which is highly efficient with reduced energy loss.

Moreover, a further aspect of the present invention is to provide an apparatus that is easily portable and temporarily interconnects a transformer assembly to a low-impedance loudspeaker system.

In order to provide these aspects and others, the present invention provides a portable device including an impedance matching transformer and interconnects to facilitate temporary connections. An impedance matching device including a transformer having an input side and an output side, wherein the output side includes a first coil having a first resistance and a second coil having a second resistance. The input side includes a first coil having a first resistance, a second coil having a second resistance, and a third coil having a third resistance. An input power connector having four electrical contacts is electrically connected to the input side of the transformer, and a pass through output power connector is electrically connected to the input side of the transformer, and the pass through output connector also is electrically connected in parallel to the input power connector. Wires are provided internally to select which input coil is connected to the input connector. A speaker output connector having four electrical contacts is included, wherein a first pair of the four electrical contacts is connected electrically to the first coil, and a second pair of the four electrical contacts is connected electrically to the second coil.

The transformer preferably is located on a removable cover plate of the portable device, along with three removable connectors. Two of the connectors allow a line originating at an amplifier to input a signal to the transformer's primary winding and then pass through the device to other same devices. The third connector is the transformer's secondary winding for connection to a loudspeaker or loudspeakers on a removable basis.

The transformer secondary winding is configured to support either an 8 or 4 ohm load, allowing the possibility of connecting one 8 ohm loudspeaker, or pair of 8 ohm loudspeakers or one 4 ohm loudspeaker to the transformer secondary winding.

In a preferred embodiment, the transformer primary winding is configured to derive 600 watts from a 200 volt line. The portable device can be internally modified to alternatively supply 300 or 150 watts. A reconfigured primary winding provides operation at voltages greater or less than 200 volts. The calculated impedance of each winding preferably is 66 Ohms, 133 ohms, and 266 ohms, respectively. For example, 15 transformers would result in a calculated load of 4.4 ohms to the amplifier. Readily available large format amplifiers (typically marketed for use with subwoofers or low frequency transducer arrays) are well equipped to power 15 transformers and their connected loads.

The device is configured to operate with industry standard, off the shelf/readily available 2-conductor loudspeaker cable assemblies. The device includes facilities for passing a signal through it, unmodified and untapped. This, when used in combination with 3 or 4 conductor cabling, compatible connectors, and a terminating cable at either end, allows for a line loss balanced system such that the power delivered to each loudspeaker is uniform, regardless of cable lengths between the transformers and the amplifier.

The device is such that it is not specific to any loudspeaker configuration. Any brand of amplifier or loudspeaker can be used so long as the voltage and impedance configurations are correct. It is not specific to any particular manufacturer(s). This allows theoretically unlimited flexibility in the design and configuration of the portable/temporary system as a whole.

The foregoing has outlined, rather broadly, the preferred features of the present invention so that those skilled in the art may better understand the detailed description of the invention that follows. Additional features of the invention will be described hereinafter that form the subject of the claims of the invention. Those skilled in the art should appreciate that they can readily use the disclosed invention and specific embodiments as a basis for designing or modifying other structures for carrying out the same purposes of the present invention, and that such other structures do not depart from the spirit and scope of the invention in its broadest form.

DETAILED DESCRIPTION OF THE PREFERRED EMBODIMENT

Figure 1:
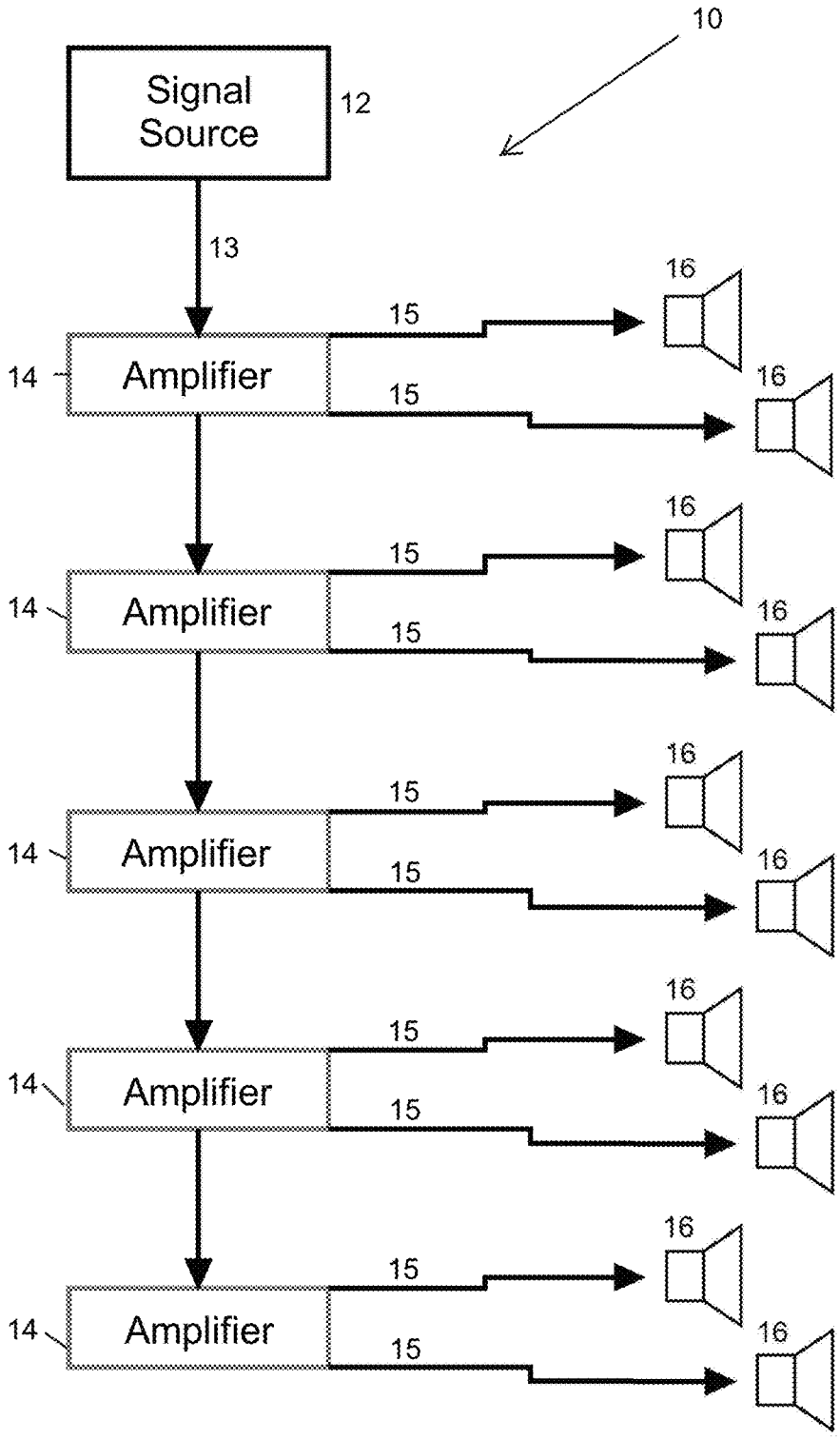
FIG. 1 is a block diagram of a first conventional setup for temporarily connecting a plurality of speakers to a signal source.

Referring now to the drawings, FIG. 1 illustrates a block diagram of a first conventional setup 10 for temporarily connecting a plurality of speakers to a signal source. The output 13 of a signal source or audio source 12 is connected to plurality of amplifiers 14 whose inputs are connected in parallel. An output 15 of each amplifier 14 is connected to a loudspeaker or loudspeakers 16. Loudspeaker or loudspeakers 16 can be connected directly to the amplifiers 14, with a few restrictions. The total impedance of all the connected loudspeakers 16 must be within the working limits of each of the amplifiers 14. As more loudspeakers 16 are added, the overall impedance decreases. Eventually, the impedance decreases to a value that is outside of what any amplifier can reasonably be expected to power, and moreover, the value can become so low that cable size and quantity quickly become impractical or cost prohibitive.

Additional amplifiers can be utilized to distribute the quantity of loudspeakers between multiple circuits. This can be a considerable disadvantage for several reasons. First, there is the added cost and complexity of the additional amplifiers. Second, depending on the physical arrangement of loudspeakers, most likely a significant quantity of additional cabling will be required, adding cost and complexity to the system. Furthermore, because the system voltage is relatively low, and current is relatively high, voltage drop presents a problem. Speakers that are farther away from an amplifier will sound quieter than those that are closer. A large portion of power is lost as heat across long cable runs. This must be overcome by either using larger amplifiers, at a higher cost, or thicker cables, also at a higher cost. An advantage of illustrated setup 10 is that higher power ratings are often used. In small setups, such as two speakers and an amplifier, for example, it is not uncommon to see 1,000 watt amplifiers in use.

Figure 2:
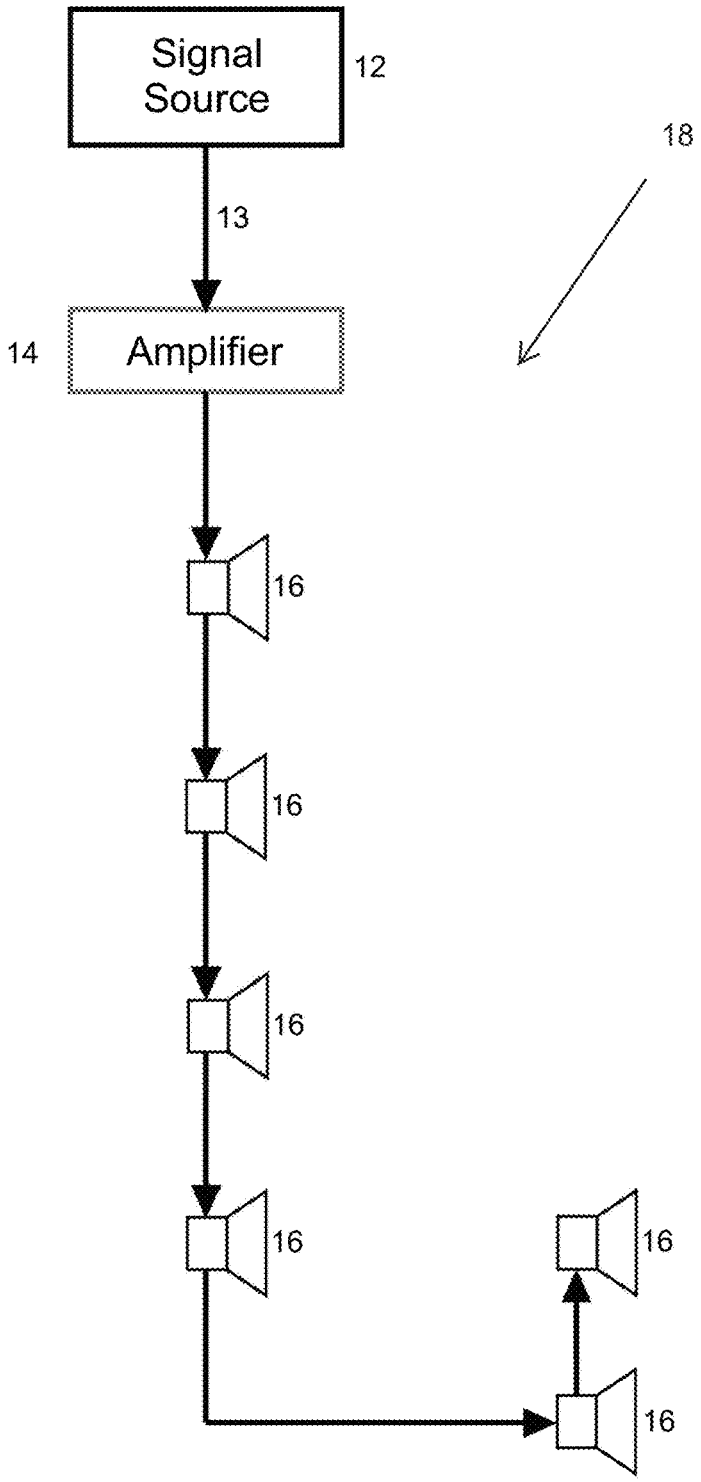
FIG. 2 is a block diagram of a second conventional setup for temporarily connecting a plurality of speakers to a signal source.

FIG. 2 illustrates a block diagram of a second conventional setup 18 for temporarily connecting a plurality of loudspeakers 16 to a signal source 12. The output 13 of a signal source 12 is connected to a single amplifier 14. Speakers 16 are connected in parallel with the amplifier 14. Speakers are commonly sold with impedance matching transformers built into them. This provides a user with the ability to connect a higher quantity of loudspeakers to one amplifier due to the individual loudspeakers each having a higher impedance. Amplifiers must be of suitable size and construction so as to output a higher voltage. This concept is time honored and commonly used, although it has some drawbacks. A common system voltage is 70 volts. As such, at high power levels current is not that much lower than with a transformerless system as described in FIG. 1. This voltage does not solve the problem of long cable runs losing significant power. Higher voltages can be utilized, but this practice is uncommon.

In researching and designing this invention, loudspeakers with built-in transformers operating at more than 400 watts were not readily available. Most loudspeakers that include built-in transformers are for smaller, low power applications. Only a few were found with 400 watt transformers. None of them were designed for portable use, and would have needed modifications to be used in a portable application. Moreover, 400 watts was deemed to be too low for most high level sound reinforcement applications. Custom built loudspeakers could have been manufactured with higher powered transformers included. This presents a disadvantage in the form of always having transformers inside them. While wiring methods exist that would allow the transformer to be bypassed on an as needed basis, the added weight would always be present. This was determined to be undesirable and impractical. Additionally, as the interior volume of a loudspeaker cabinet plays a significant role in its design, adding high-power transformers to existing, readily available loudspeakers goes against industry best practices. The loss of interior cabinet space occupied by the transformer would present negative consequences. The setup 18 also does not offer any means of balancing line loss. As such, the loudest speaker will be the one closest to the amplifier. The second one, slightly quieter, and so on. The last loudspeaker ends up being noticeably quieter than the first. This is especially problematic when the last loudspeaker is close to the first loudspeaker in a second set of loudspeakers.

Figure 3:
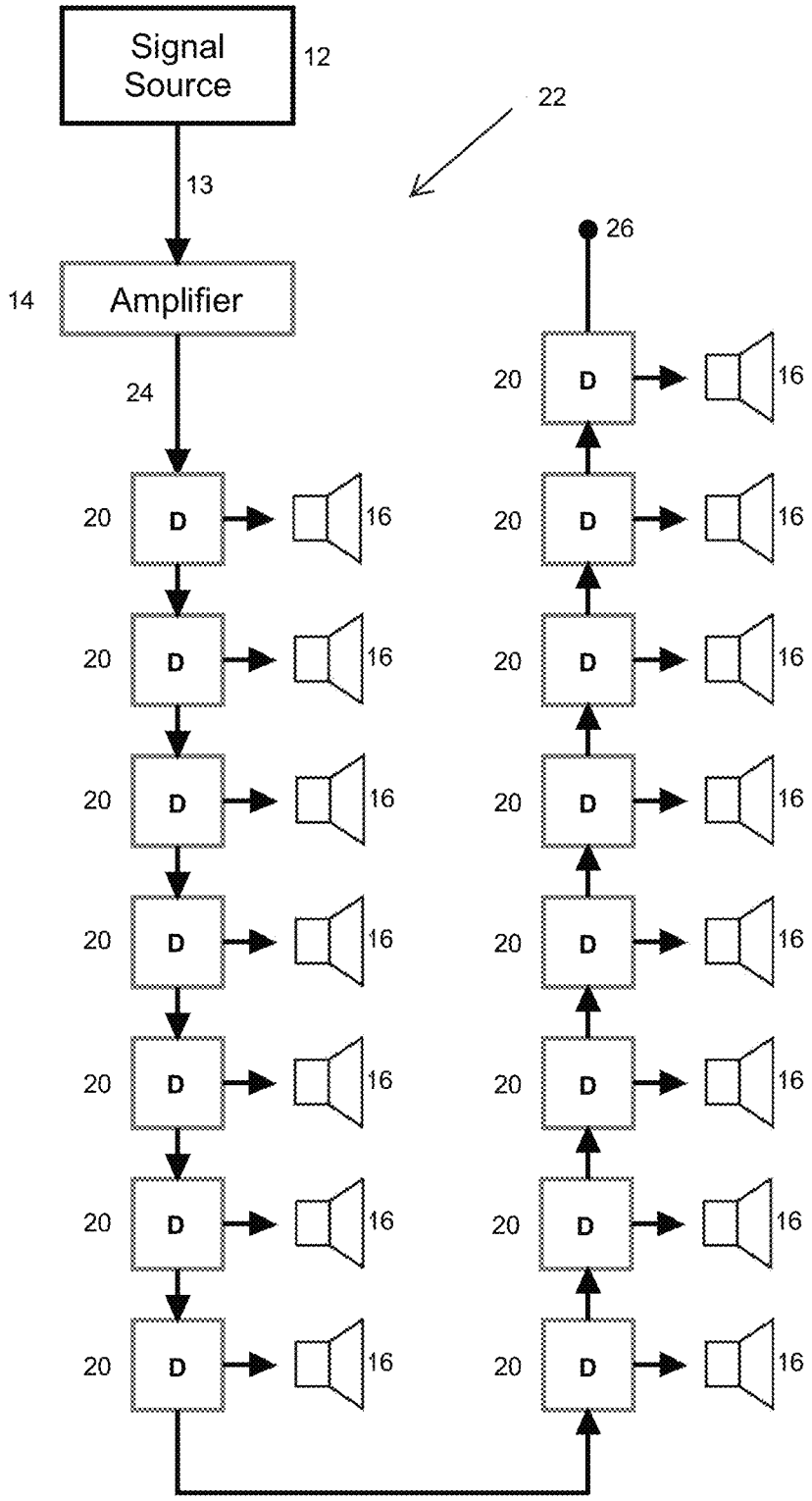
FIG. 3 is a block diagram of a setup for temporarily connecting a plurality of speakers to a signal source in accordance with the present invention.

FIG. 3 illustrates a block diagram of a setup 22 for temporarily connecting a plurality of speakers 16 to a signal source 12 in accordance with the present invention. The signal source 12 is connected to a single amplifier 14 which is then connected in parallel to a plurality of Impedance Matching Devices (IMDs) 20 configured in accordance with the present invention. Readily available 8 ohm or 4 ohm loudspeakers 16 are connected to an impedance matching device (IMD) 20 configured in accordance to the present invention. The present invention enables "off-the-shelf" portable loudspeakers 16 to be utilized in a large, distributed application without modifications. The end result is the loudspeakers 16 acting as if they were connected directly to an amplifier 14, such as a 600-watt amplifier, with a short length of cable, but with the benefits of a higher system voltage and lower current. This keeps costs associated with cabling to a minimum.

A "start cable" 24 and an "end cable" 26 facilitate this balanced line wiring method. The start cable connects the negative output from the amplifier 14 to the negative terminal of each IMD 20. The amplifier positive connection is connected to the alternate set of parallel conductors that pass through each IMD 20 unbroken. The IMD's negative connection is not connected to anything in the start cable, and is insulated to prevent possible accidental interconnection with other conductors.

The end cable takes the amplifier 14 positive signal from the unbroken pass-through conductors and relocates it to the IMD 20 positive connections/conductors. An output connector is provided for connection to additional devices or for testing and measurement purposes.

With this, voltage drop, or line loss, is even throughout the system because the "round trip" distance from the amplifier to the device is the same anywhere in the system. All the speakers 16 are presented with the same signal strength, and sound pressure level or volume is the same for all the speakers 16. This is regardless of the loudspeakers 16 distance from the amplifier 14 shown in FIG. 5 or the length of the cables between the portable IMDs 20.

Figure 4:
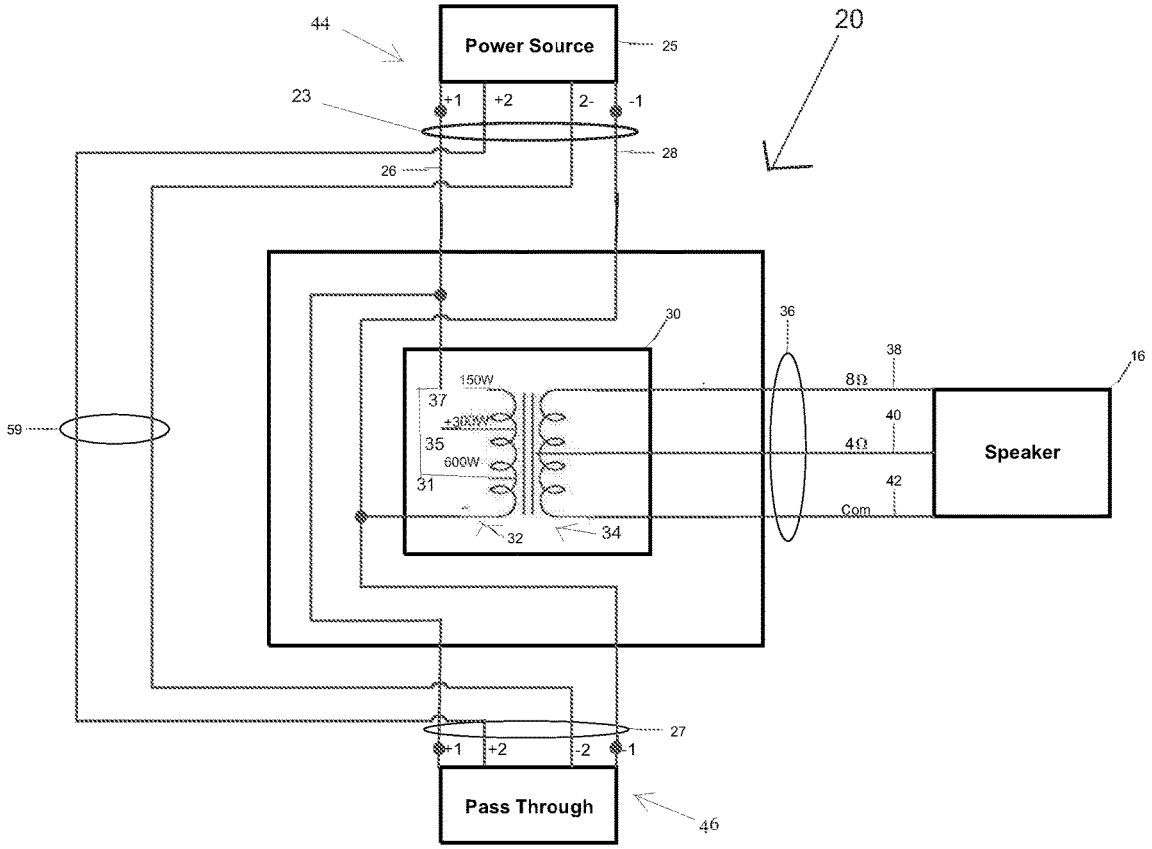
FIG. 4 is a block diagram of the impedance matching device (IMD) shown in FIG. 3 configured in accordance with the present invention.

FIG. 4 illustrates a block diagram of the Impedance Matching Device (IMD) 20 configured in accordance with the present invention. The IMD 20 is configured to have an input 23 connected to an amplified signal source 25 via positive input line (+) 26 and a common or ground input line (−) 28. Pursuant to the setup 22 illustrated in FIG. 3, the power source 25 can be an amplifier 14, or a pass-through output 27 of a prior IMD 20 connected in parallel with the amplifier 14 and the IMD 20 shown in FIG. 4. The positive or hot wire or line 26 and the common or ground wire or line 28 are connected to the input 23 of the IMD 20, which is electrically connected to the input or primary side 32 of a transformer 30 located within the IMD 20. The output or secondary side 34 of the transformer 30 of the IMD 20 is electrically connected to a speaker output 36 of the IMD 20. The speaker output 36 includes a first output line 38, a second output line 40, and a common or ground line 42. Using a 600 watt power source, the first output line 38 preferably outputs 69.282 volts at 8 Ohms resistance, and the second output line 40 preferably outputs 48.99 volts at 4 Ohms resistance.

In accordance with the present invention, an 8 ohm speaker 16 can be connected to the first output line 38 and the common line 42, or a 4 ohm speaker or pair of 8 ohm speakers 16 can be connected to the second output line 40 and the common line 42.

The IMD 20 includes a pass-though output 27 that is connected to the input 23 of the IMD 20. Accordingly, the positive line 26 of the input 23 is connected electrically to the positive line of the pass-though output 27, and the common line 28 of the input 23 is connected electrically to the common line of the pass-through output 27. Both the input 23 and the pass-through output 27 are to be connected to electrical connectors, preferably four-pole or four-conductor connectors. The IMD 20 also provides an alternate channel pass-through 59 between the input 23 and the output 27.

Figure 5:
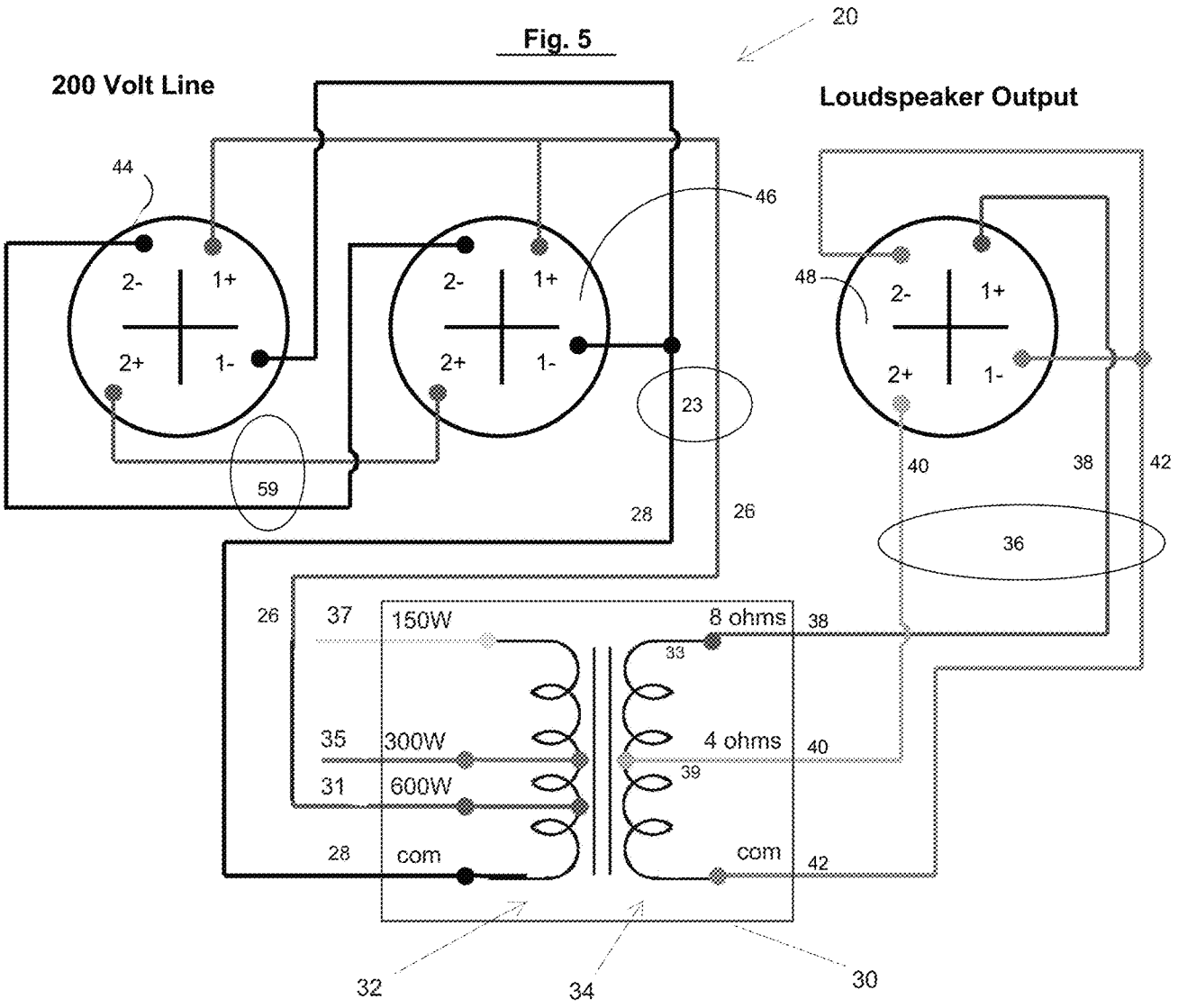
FIG. 5 is a wiring diagram of the IMD shown in FIGS. 3 and 4.

FIG. 5 illustrates a wiring diagram of the IMD 20 configured in accordance with the present invention. Illustrated is the transformer 30 contained within the IMD 20. The input side or primary side 32 of the transformer 30 is shown, and the secondary side or output side 34 of the transformer 30 is shown. The input side 32 includes a single coil 31 connected electrically between the hot line 28 and the common line 26 of the input 23. A preferred transformer 30 to be used in the IMD 20 of the present invention is the WS600 from EDCOR Electronics Corporation in Carlsbad, N. Mex. This EDCOR transformer model provides a 600-watt connection to coil 31, a 300-watt connection to input coil 35, and a 150-watt connection to input coil 37 of the transformer 30. In the preferred embodiment, only the 600-watt connection to the coil 31 is connected to the input 23 of the IMD 20.

The output 36 of the IMD 20 is connected to the output coil 33 between the hot line 38 and the common line 42 having 8 ohms impedance, and an output coil 39 between the hot line 40 and the common line 42 having 4 ohms impedance.

In accordance with the present invention, the input 23 of the IMD 20 is connected in parallel to two 4-conductor inputs. The preferred 4-input connector utilized in the present invention is an NLT4MP connector manufactured by Neutrik AG in Liechtenstein. The input connector 44 preferably includes two pairs of contacts (+1, −1, +2, −2). Similarly, the pass-through connector 46, which is connected to input connector 44, uses the same connector having two pairs of contacts (+1, −1, +2, −2). In this manner, the amplified signal provided from the amplifier 14 shown in FIG. 3 to the input 23 of the IMD 20 also provides the same amplified signal to the next IMD 20 connected in parallel with the prior IMD 20. Additionally, the alternate channel pass-through 59, not connected electrically to the transformer 30, can electrically pass through the IMD 20 to another IMD 20.

The output 36 of the IMD 20 also is connected electrically to a 2-pair connector 48 (+1, −1, +2, −2), which preferably is the same as the input connector 44 and the pass-though output connector 46. The 8 ohm output from the transformer 30 from output coil or secondary winding 33 is connected to the hot or positive line 38, which is connected to the +1 pin of the connector 48, and the negative or common output line 42 is connected to the −1 pin of the connector 48. Additionally, the 4 ohm output 40 from the transformer 30 from output coil or secondary winding 39 is connected to the hot or positive output line 40, which is connected to the +2 pin of the connector 48, and the negative or common output line 42 is connected to the −2 pin of the connector 48. It should be noted that the −1 pin and the −2 pin of the output connector or speaker connector 48 are wired in parallel and are connected together to share a common ground or negative.

In accordance with the present invention, this 2-pair speaker connector 48 enables a user to easily connect an 8 or 4 ohm speaker to a similar impedance output on the IMD 20, including connecting a speaker to an output with a non-matching impedance output, if desired, such as an 8 ohm speaker to a 4 ohm output to deliberately yield a quieter output in applications where this is desirable.

Figure 6A:
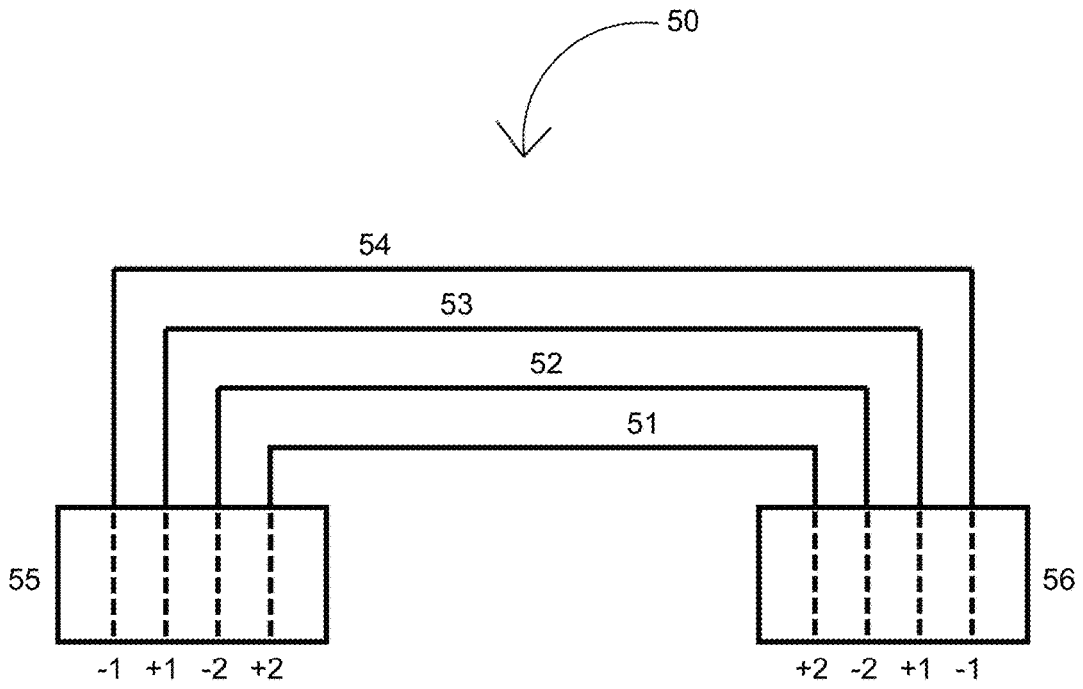
FIG. 6*a* is a wiring diagram of a conventional interconnecting cable used with the present invention, related components and adapter cable assemblies.

FIG. 6*a* illustrates a conventional interconnecting cable 50. The cable 50 includes 4 lines 51, 52, 53, and 54, and two four-contact connector plugs 55 and 56. FIG. 6*a* Illustrates a line 54 connecting contact pin −1 on plug 55 with contact pin −1 on plug 56, a line 53 connecting contact pin +1 on plug 55 with contact pin +1 on plug 56, a line 52 connecting contact pin −2 on plug 55 with contact pin −2 on plug 56, and a line 51 connecting contact pin +2 on plug 55 with contact pin +2 on plug 56. The cable 50 is used as a universal interconnect between the amplifier 14 and start cable 24. The cable 50 also connects the first IMD 20 pass through output connection 46 to the second IMD 20 input connection 44, and so on. This interconnecting cable 50 also is used between the IMD speaker output 48 and the input of the first connected loudspeaker 16. The interconnecting cable 50 also is used after the cable 60 (FIG. 6*b*) to connect between the IMD 20 with adapter to one or more loudspeakers.

Figure 6B:
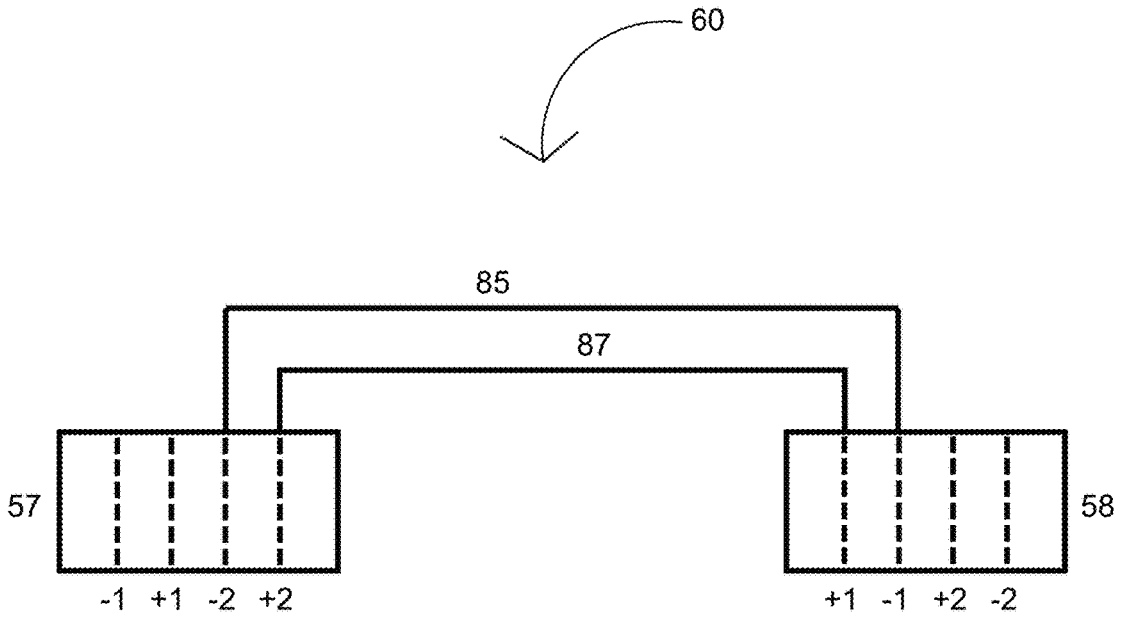
FIG. 6*b* is a wiring diagram of adapter cable assemblies configured in accordance with further aspects of the present invention.

FIG. 6*b* illustrates an adapter cable 60 configured in accordance with the present invention, wherein pins −1 and +1 of plug 57 are open, and pins −2 and +2 of connector 58 are open. Pin −2 of plug 57 is connected to pin −1 of connector 58 via line 85, and pin +2 of plug 57 is connected to pin +1 of connector 58 via line 87. The cable 60 effectively supplies the signal present on pin +2 of line 40 of the speaker output connector 48 and pin −2 of line 42 of the speaker output connector 48 connections and relocates these to −1 and +1 on the output connector 58 of cable 60. In this manner, a second 8 Ohm speaker or a single 4 Ohm speaker 16 can be connected to an IMD 20 while maintaining the same input impedance as compared to other IMDs 20 connected to a single speaker in the configuration shown in FIG. 3.

Figure 7:
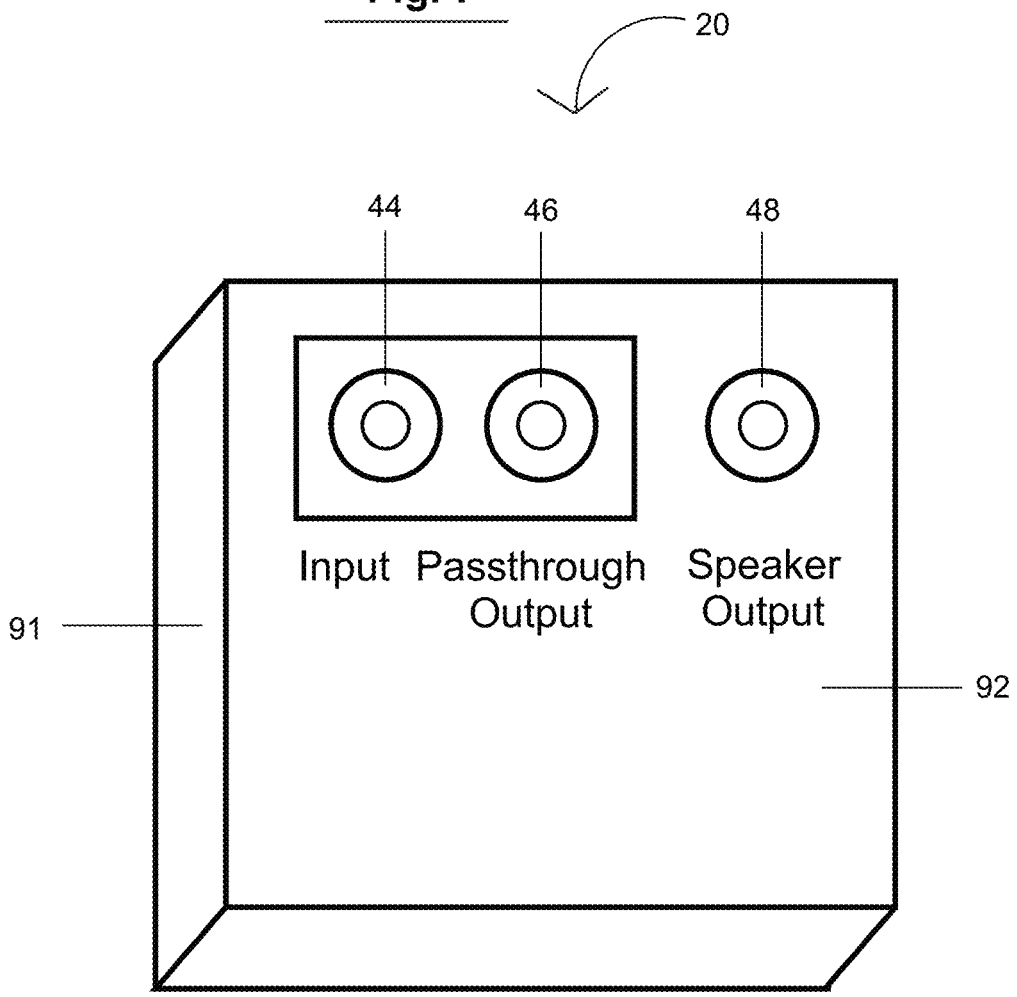
FIG. 7 is a perspective view of a preferred housing for the IMD shown in FIGS. 3-5.

FIG. 7 is a perspective view of the housing 91 for enclosing the components of the IMD 20 configured in accordance with the present invention. The housing 91 includes a front plate 92 for mounting the input connector 44, pass-through connector 46, and speaker output connector 48. The transformer 30 preferably is mounted to the back of the plate 92. The housing 91 enables the IMD 20 to be compact, lightweight, durable, and relatively inexpensive to manufacture.

Figure 8A:
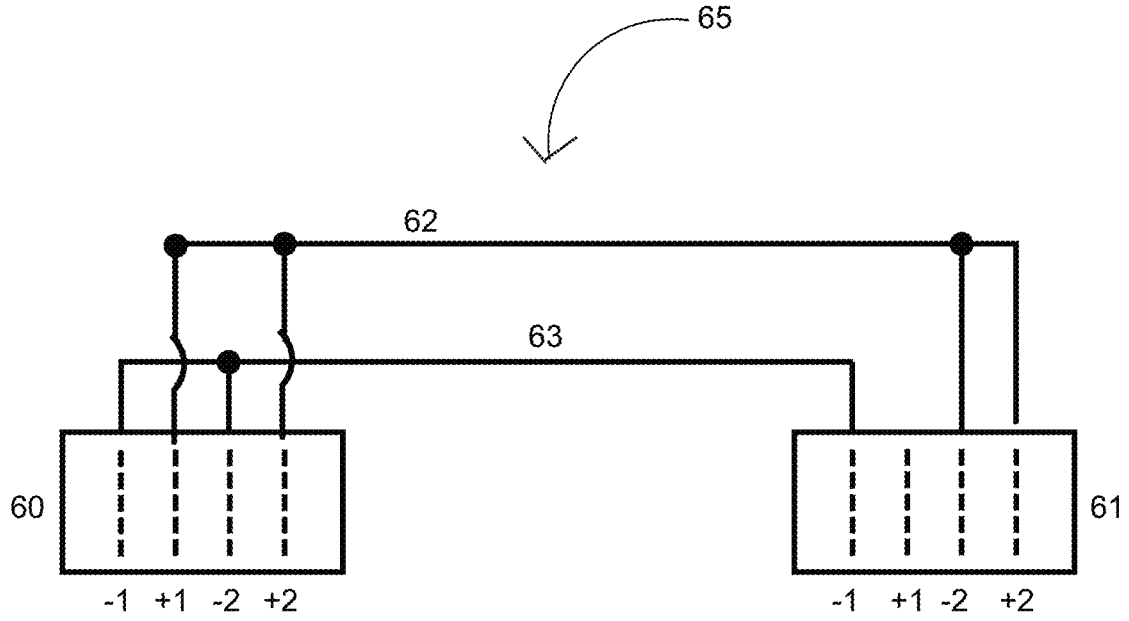
FIG. 8*a* illustrates the first of two cables used to facilitate balancing the current between all devices.

FIG. 8*a* illustrates a first cable 65 of two cables (65, 70) used to facilitate balancing the current between all devices. The amplifier 14 is connected with the interconnecting cable 50 to the input connector 60 of the cable 65. The cable 65 connects both pins +1 and +2 on the input connector 60 to both lines −2 and +2 on the output plug 61 utilizing line 62 of cable 65. Pins −1 and −2 on the input connector 60 are connected to pins −1 on the output plug 61 utilizing line 63. Pin +1 on the output plug 61 is non-terminated. The output plug 61 on the cable 65 connects to the input jack 44 on the first IMD 20 in a circuit consisting of multiple IMDs 20.

Figure 8B:
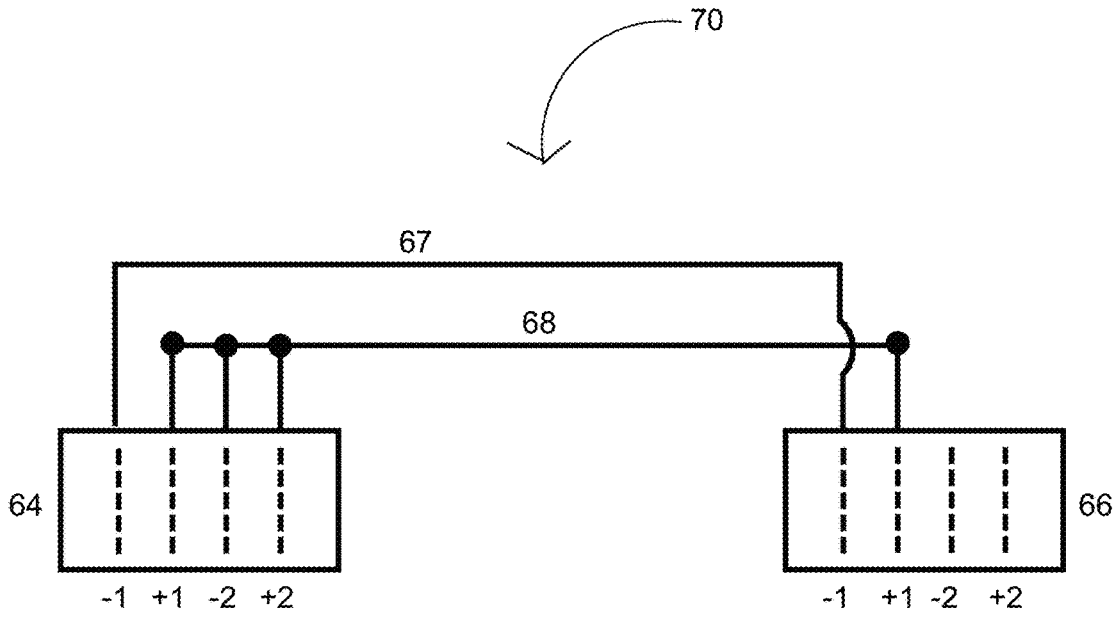
FIG. 8*b* illustrates the second of two cables used to facilitate balancing the current between all devices.

FIG. 8*b* illustrates the second cable 70 of two cables (65,70) used to facilitate balancing the current between all devices. The input plug 64 is connected to the pass through output connector 46 on the last IMD 20 on a circuit consisting of multiple IMDs 20. Pins +1, +2, and −2 on input plug 64 are connected with line 68 to the +1 pin of output connector 66. Pin −1 on the input plug 64 is connected with line 67 to the −1 pin of the output connector 66. Pins +2 and −2 on output connector 66 are non-terminated.

Figure 8C:
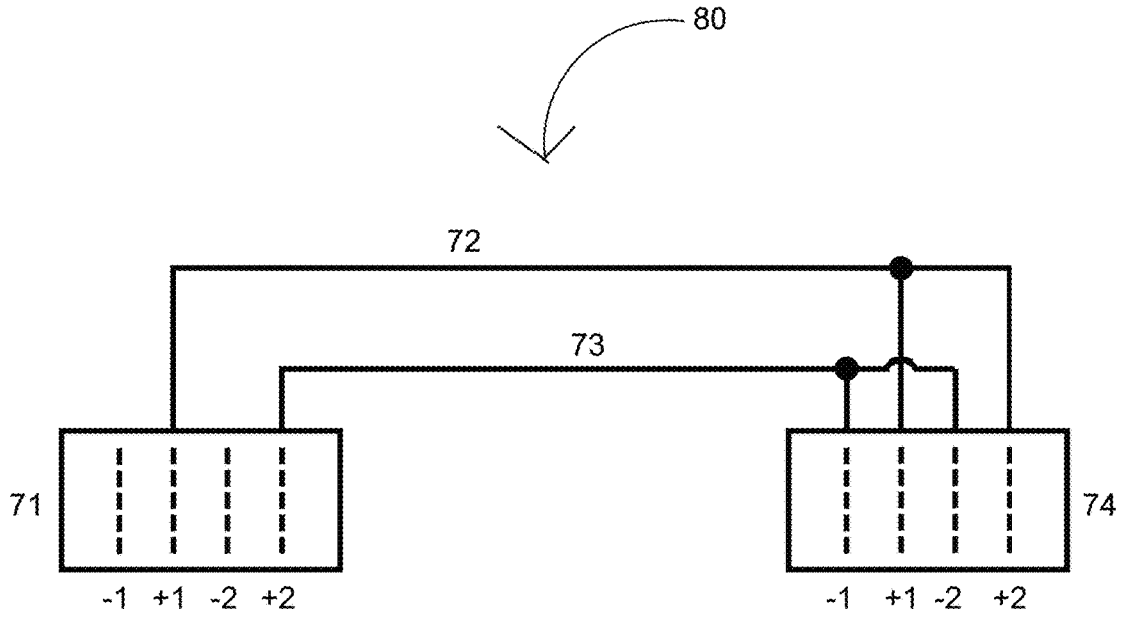
FIG. 8*c* illustrates an adapter cable used to connect the output of amplifier 14 to the input of start cable assembly 59 by way of an interconnecting cable 50.

FIG. 8*c* illustrates an adapter cable 80 used to connect the output of amplifier 14 to the input of start cable assembly 59 (FIG. 8*a*) by way of the interconnecting cable 50. The input plug 71 is connected to the output of an amplifier 14. Pin +1 on the input plug 71 is connected with line 72 to both pin +1 and pin +2 on the output connector 74. Pin +2 on the input plug 71 is connected with line 73 to both pin −1 and pin −2 on the output connector 74. An interconnect cable 50 is then connected to the input connector of the start cable assembly 59. Certain amplifiers may not require the use of this cable 80 due to having this functionality built-in or a hardwired patch panel 76 being utilized, as shown in FIG. 9.

Figure 9:
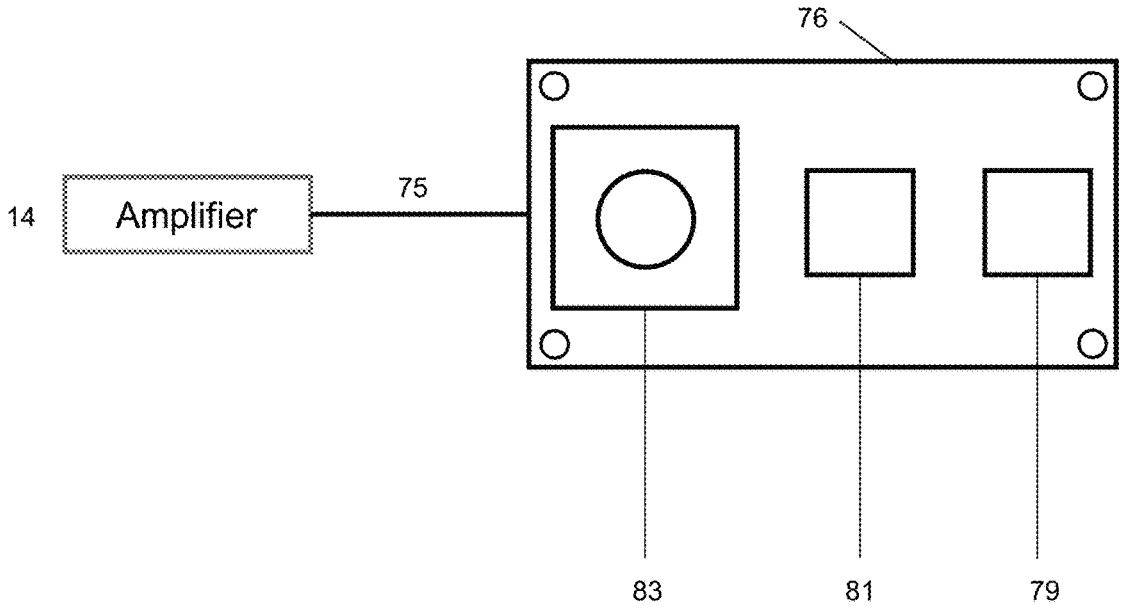
FIG. 9 is a perspective view of an alternate connection method that can be used in place of FIG. 8*c*.

FIG. 9 illustrates a hardwired patch panel 76 with an output connector 83 mounted on it. The output connector 83 is directly connected (hardwired) to the output of amplifier 14 using wires or a cable 75 with bare ends. Optional crimped, soldered, exothermally welded or mechanically attached lugs or terminals may also be utilized in connecting the bare ends of the cable 75 to amplifier 14. An interconnect cable 50 connects output connector 83 to the input connector 60 of the start cable assembly 65. An input connector or connectors 79 may also be present on panel 76 to connect a signal or audio source 12 to amplifier 14. Additional connectors 81 may also be present, as required, on panel 76 for connections such as an electrical power supply, remote control/monitoring data, additional inputs/outputs, interconnects for unrelated units, etc.

While specific embodiments have been shown and described to point out fundamental and novel features of the invention as applied to the preferred embodiments, it will be understood that various omissions and substitutions and changes of the form and details of the invention illustrated and in the operation may be done by those skilled in the art, without departing from the spirit of the invention.

The invention claimed is:

1. An impedance matching device, comprising:

a transformer having an input side, wherein the input side includes a first input having a first input impedance, a second input having a second input impedance, and a third input having a third input impedance and an output side, wherein the output side includes a first output having a first output impedance, a second output having a second output impedance, and a common ground output;

an input connector electrically connected to the input side of the transformer;

a pass-through output connector electrically connected to the input side of the transformer, wherein the pass-through output connector also is connected electrically to the input connector; and a speaker output connector having four electrical contacts, wherein a first pair of the four electrical contacts is connected electrically to the first output, and a second pair of the four electrical contacts is connected electrically to the second output.

2. The impedance matching device of claim 1, further comprising:

a housing containing the transformer, the input connecter, the pass-through output connector, and the speaker output connector.

3. The impedance matching device of claim 2, wherein the housing includes a front plate, and the transformer, the input connecter, the pass through output connector, and the speaker output connector are connected to the front plate.

4. The impedance matching device of claim 1, wherein the further comprising:

an adapter connector wired to interchange connector pine assignments between an input connector and an output connector.

5. The impedance matching device of claim 1, wherein the first output connects to an approximate impedance of eight ohms (8Ω), and the second output connects to an approximate impedance of four ohms (4Ω).

6. The impedance matching device of claim 1, wherein the first output is connected to a first location on an output coil of the transformer, and the second output is connected to a second location of the output coil of the transformer.

7. An impedance matching device, comprising:

a transformer having an input side, wherein the input side includes a first input having a first input impedance, and an output side, wherein the output side includes a first output having a first output impedance;

an input connector electrically connected to the input side of the transformer;

a pass-through output connector electrically connected to the input side of the transformer, wherein the pass-through output connector also is connected electrically to the input connector; and a speaker output connector connected electrically to the first output.

8. The impedance matching device of claim 7, wherein the output side of the transformer further comprises:

a second output having a second output impedance; and a common ground output.

9. The impedance matching device of claim 8, wherein the speaker output connector includes four electrical contacts, wherein a first pair of the four electrical contacts is connected electrically to the first output, and a second pair of the four electrical contacts is connected electrically to the second output.

10. The impedance matching device of claim 8, wherein the first output connects to an approximate impedance of eight ohms (8Ω), and the second output connects to an approximate impedance of four ohms (4Ω).

11. The impedance matching device of claim 7, wherein the input side of the transformer further comprises:

a second input having a second input impedance; and a common ground input.

12. The impedance matching device of claim 11, wherein the input side of the transformer further comprises;

a third input having a third input impedance.

13. The impedance matching device of claim 11, wherein the first output is connected to a first location on an output coil of the transformer, and the second output is connected to a second location of the output coil of the transformer.

14. The impedance matching device of claim 7, wherein the further comprising:

an adapter connector wired to interchange connector pin assignments between an input connector and an output connector.

15. An impedance matching device, comprising:

a transformer having an input side, wherein the input side includes a first input for receiving a first power level input, and an output side, wherein the output side includes a first output having a first output impedance;

an input connector electrically connected to the input side of the transformer;

a pass-through output connector electrically connected to the input side of the transformer, wherein the pass-through output connector also is connected electrically to the input connector; and a speaker output connector connected electrically to the first output.

16. The impedance matching device of claim 15, wherein the output side of the transformer further comprises:

a second output having a second output impedance; and a common ground output.

17. The impedance matching device of claim 16, wherein the speaker output connector includes four electrical contacts, wherein a first pair of the four electrical contacts is connected electrically to the first output, and a second pair of the four electrical contacts is connected electrically to the second output.

18. The impedance matching device of claim 16, wherein the first output connects to an approximate impedance of eight ohms (8Ω), and the second output connects to an approximate impedance of four ohms (4Ω).

19. The impedance matching device of claim 15, wherein the input side of the transformer further comprises:

a second input for receiving a second power level input; and a common ground input.

20. The impedance matching device of claim 19, wherein the transformer further comprises;

a third input for receiving a third power level input.

* * * * *